US006435061B1

(12) United States Patent
Ho

(10) Patent No.: US 6,435,061 B1
(45) Date of Patent: Aug. 20, 2002

(54) RATCHET SCREWDRIVER

(75) Inventor: Shih-Chi Ho, Taichung Hsien (TW)

(73) Assignee: Yeh-Hsing Enterprise Co., Ltd., Taichung Hsien (TW)

( * ) Notice: Subject to any disclaimer, the term of this patent is extended or adjusted under 35 U.S.C. 154(b) by 0 days.

(21) Appl. No.: 09/971,384

(22) Filed: Oct. 5, 2001

(51) Int. Cl.[7] ..... B25B 13/00
(52) U.S. Cl. ..... 81/58.4; 81/63.1; 81/60
(58) Field of Search ..... 81/58.4, 60–63.2; 192/43, 43.1

(56) References Cited

U.S. PATENT DOCUMENTS 4,696,208 A * 9/1987 Lay ..... 81/58
5,379,873 A * 1/1995 Shiao ..... 192/43
5,806,381 A * 9/1998 Lin ..... 81/451
6,151,995 A * 11/2000 Shu ..... 192/43.1
6,240,810 B1 * 6/2001 Ho ..... 192/43.1
6,330,843 B1 * 12/2001 Lin ..... 81/62

* cited by examiner

*Primary Examiner*—Joseph J. Hail, III
*Assistant Examiner*—David B. Thomas
(74) *Attorney, Agent, or Firm*—Harrison & Egbert

(57) ABSTRACT

A ratchet screwdriver includes a handle, a main body, a shank, two check plates, a shifter, a position confining plate, and a tubular housing. The check plates are provided with an inclined edge, a reinforcing edge and a protruded edge. The inclined edge is intended to enable the check plates to be effectively actuated by the shifter. The reinforcing edge serves to enhance the structural strength of the check plates. The protruded edge serves to prevent the check plates from displacing. The main body is provided with two protruded ribs to securely position the tubular housing. The position confining plate is provided with two pillars, with one end of the pillars being received in the guided slot of the main body, and with the other end of the pillars being fitted into a recovery spring to enable the position confining plate to return to its original position.

1 Claim, 9 Drawing Sheets

RATCHET SCREWDRIVER

BACKGROUND OF THE INVENTION

1. Field of the Invention

The present invention relates generally to a screwdriver, and more particularly to a ratchet screwdriver.

2. Description of Related Art

As shown in FIGS. 1 and 2, a prior art ratchet screwdriver comprises a main body 11 which is provided with an axial hole 13 having a receiving portion 12 via which a shank 10 is engaged with the main body 11. The shank 10 is provided in the inner end with a gear 14, which is confined by a position confining plate 16 disposed in an insertion slot 15 of the main body 11. The main body 11 is fitted into a tubular housing 17 which is provided with an assembly hole 21. The main body 11 is provided with a shifter 18 and two check plates 19. The shifter 18 has a shifting knob 22 and two feet 24. The shifting knob 22 is jutted out of the main body 11 via the assembly hole 21. The position confining plate 16 is provided with an elastic piece 25 for preventing the axial displacements of the shank 10 and the position confining plate 16.

Such a prior art ratchet screwdriver as described above is defective in design because the shifter 18 cannot be easily maneuvered due to the size of the assembly hole 21 of the tubular housing 17. In addition, the check plates 19 are provided with a recessed edge 23, which is intended to facilitate the lifting of the check plates 19 without hitting the shank 10. In light of the reduction in axial area of the check plates 19, the feet 24 of the shifter 18 are vulnerable to being trapped in the recessed edges 23 of the check plates 19 at such time when the shifter 18 is pushed to one end. Moreover, there is a gap between the position confining plate 16 and the insertion slot 15, thereby resulting in an axial displacement of the position confining plate 16 or shank 10.

BRIEF SUMMARY OF THE INVENTION

The primary objective of the present invention is to provide a ratchet screwdriver which is free of the deficiencies of the prior art ratchet screwdriver described above.

The ratchet screwdriver of the present invention is basically similar in construction to the prior art ratchet screwdriver, with the difference being that the tubular housing is provided with an assembly slot, and two insertion slots, and that the shifter is provided with a sliding slot to facilitate the shifting of the shifter. In addition, the check plates are provided with an inclined portion to enhance the efficiency of the check plates being actuated by the feet of the shifter. The position confining plate is provided with two guide pillars for preventing the axial displacement of the position confining plate in conjunction with two springs and the guide slot of the main body.

The features and the advantages of the present invention will be more readily understood upon a thoughtful deliberation of the following detailed description of a preferred embodiment of the present invention in reference to the accompanying drawings.

DETAILED DESCRIPTION OF THE INVENTION

Figure 1:
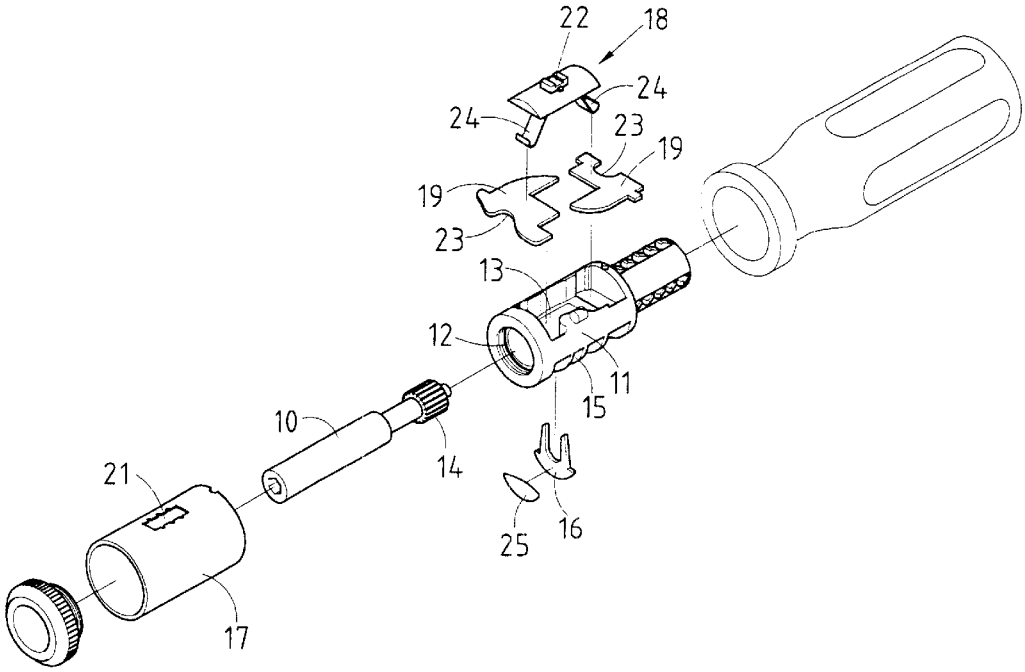
FIG.1 PRIOR ART
FIG. 1 shows an exploded view of a ratchet screwdriver of the prior art.
Figure 2:
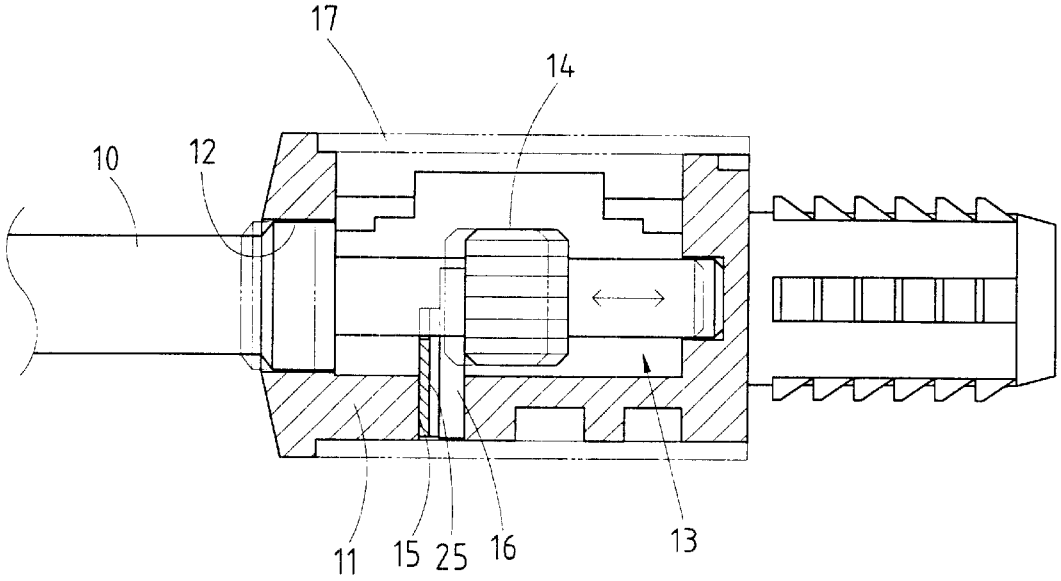
FIG.2 PRIOR ART
FIG. 2 shows a partial longitudinal sectional view of the prior art ratchet screwdriver.
Figure 3:
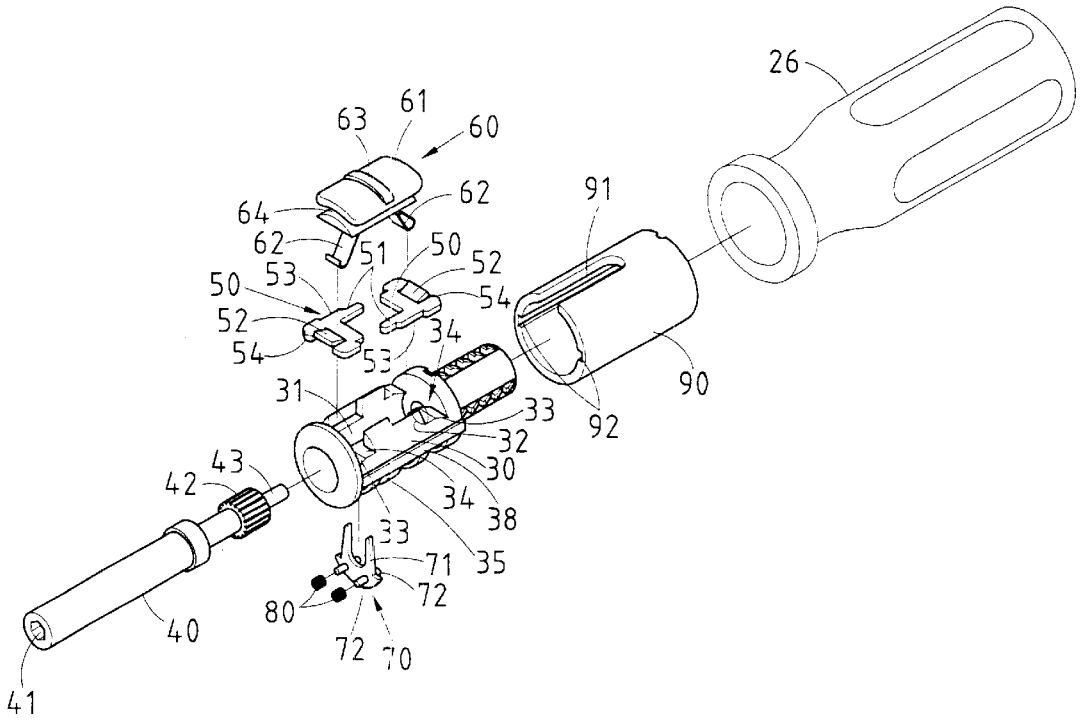
FIG. 3 shows an exploded view of the preferred embodiment of the present invention.
Figure 4:
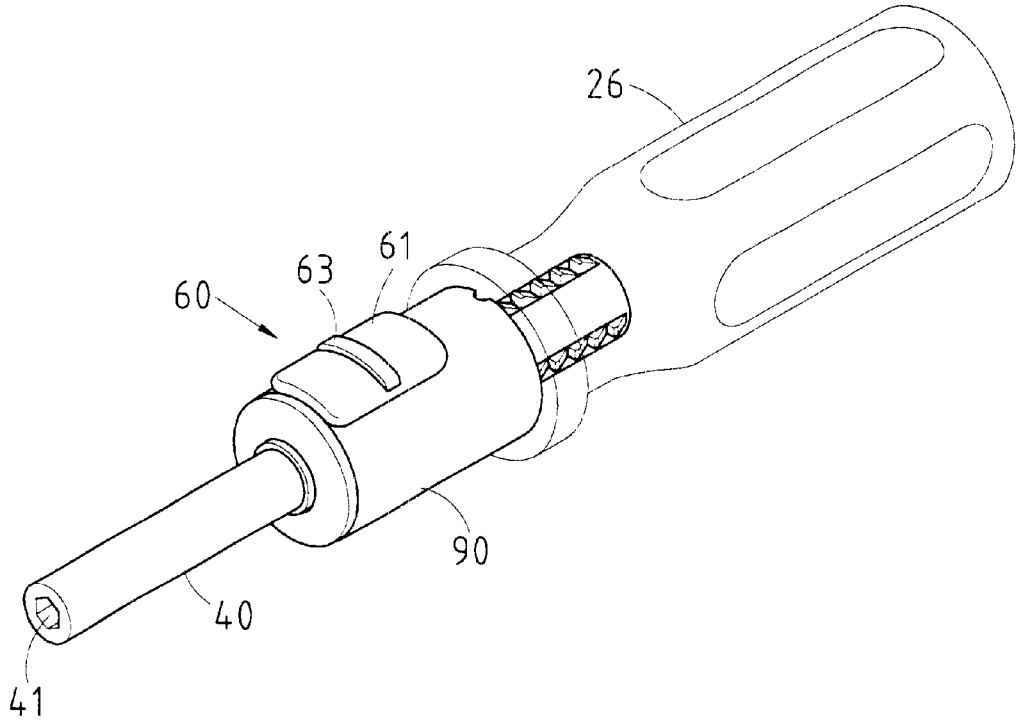
FIG. 4 shows a perspective view of the preferred embodiment of the present invention.
Figure 5:
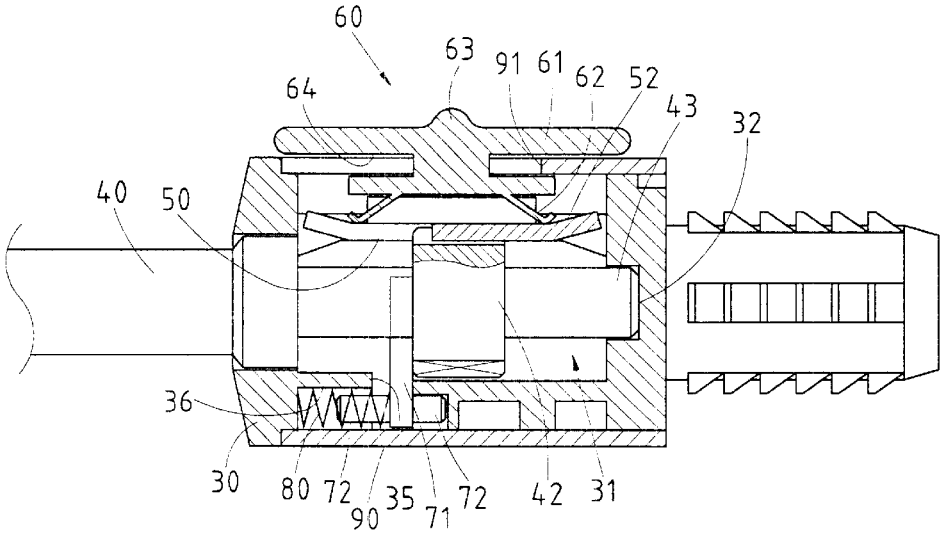
FIG. 5 shows a longitudinal side sectional view of the preferred embodiment of the present invention as shown in FIG. 4.

As shown in FIGS. 3–9, a ratchet screwdriver of the preferred embodiment of the present invention comprises a handle 26, a main body 30, a shank 40, two check plates 50, a shifter 60, a position confining plate 70, and a tubular housing 90.

The main body 30 is fastened at one end with the handle 26 and is provided at other end with an axial hole 31 having a core hole 32 and an open top. The axial hole 31 is provided in two sides with a disposition slot 34 having an inclined plane 33 and an auxiliary wing slot 37. The main body 30 is provided in the bottom side with an insertion slot 35 in communication with the axial hole 31. The insertion slot 35 is provided in two sides with a guide slot 36. The main body 30 is provided in the outer wall with two protruded ribs 38 opposite in location to each other and extending along the longitudinal direction of the main body 30.

The shank 40 is provided at the outer end with a tip slot 41, and at the inner end with a gear 42 with a pillar 43. The shank 40 is pivotally fastened in the axial hole 31 of the main body 30 such that the pillar 43 of the gear 42 is pivoted in the core hole 32 of the axial hole 31.

The check plates 50 are provided with a protruded piece 51, an inclined edge 52, a reinforcing edge 53, and a protruded edge 54. The check plates 50 are disposed in the disposition slots 34 of the main body 30.

The shifter 60 has a plate body 61 and two feet 62. The plate body 61 is provided with a rib 63 and a sliding slot 64 extending along the edge thereof The feet 62 are capable of being in contact with the inclined edges 52 of the two check plates 50.

The position confining plate 70 is disposed in the insertion slot 35 of the main body 30 such that a plate body 71 thereof stops the gear 42 of the shank 40, thereby preventing the shank 40 from sliding out of the main body 30. The plate body 71 is provided with two guide pillars 72, which are slidably received in the guide slots 36 of the main body in conjunction with a spring 80.

The tubular housing 90 is provided with an assembly slot 91 and is fitted over the main body 30 such that the plate body 61 of the shifter 60 is located over the assembly slot 91. The tubular housing 90 is provided in the inner wall with two locating slots 92 for receiving the two ribs 38 of the main body 30, thereby preventing the tubular housing from turning in relation to the main body 30.

In view of the sliding slot 64 of the plate body 61 of the shifter 60, the top of the plate body 61 is located over the assembly slot 91 of the tubular housing 90. As a result, the shifter 60 has a relatively large size to facilitate the operating of the ratchet screwdriver.

Figure 6:
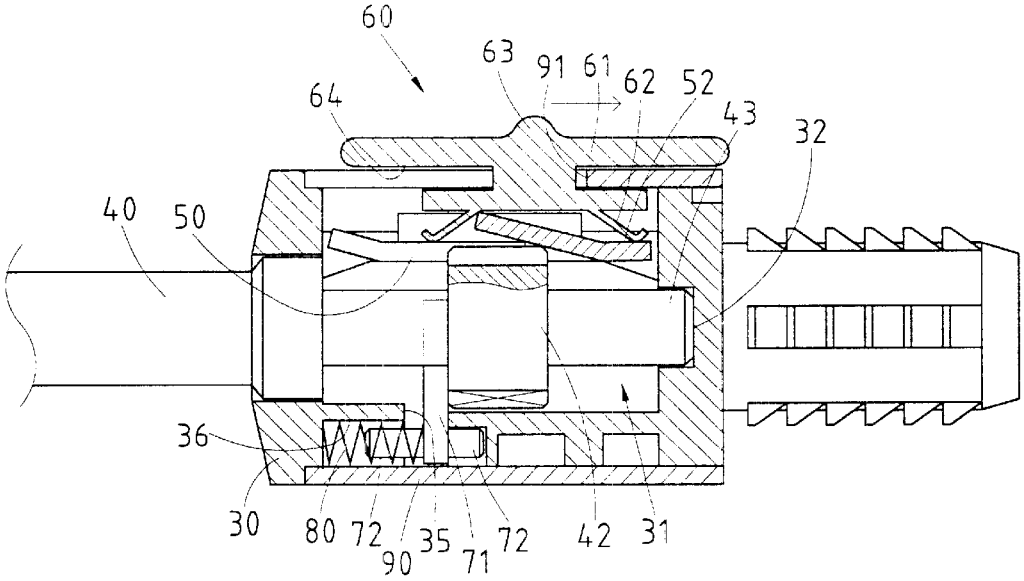
FIG. 6 shows a longitudinal side sectional view of the preferred embodiment of the present invention in action.
Figure 7:
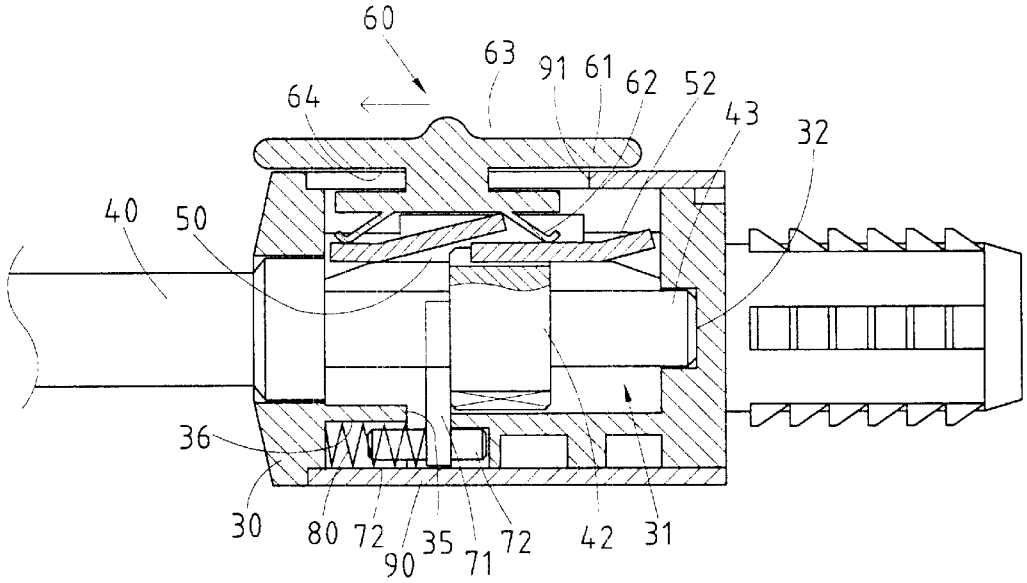
FIG. 7 shows another longitudinal side sectional view of the preferred embodiment of the present invention in action.

As show in FIGS. 6 and 7, the check plates 50 are effectively actuated by the feet 62 of the shifter 60, thanks to the inclined edges 52 of the check plates 50.

Figure 8:
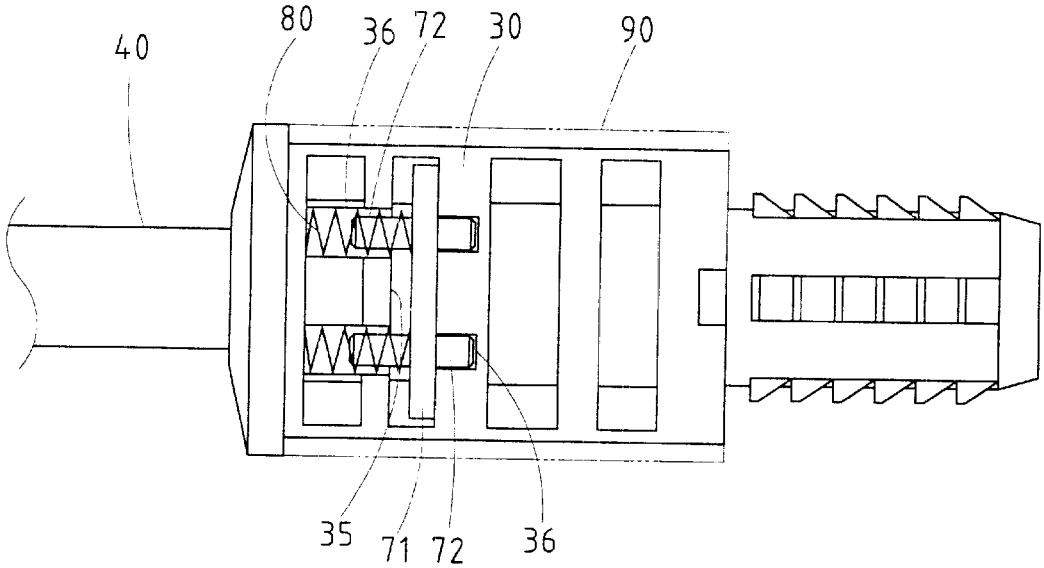
FIG. 8 shows a longitudinal bottom sectional view of the preferred embodiment of the present invention.

As shown in FIG. 8, the plate body 71 of the position confining plate 70 is provided with two pillars 72 which are received in the guide slots 36 of the main body 30 in conjunction with the recovery springs 80. The position confining plate 70 is urged by the springs 80 to rest against one side wall of the insertion slot 35 of the main body 30. In the event that the shank 40 is forced by an external force to displace, the action of the recovery force of the springs 80 enables the shank 40 to return rapidly to its original position.

Figure 9:
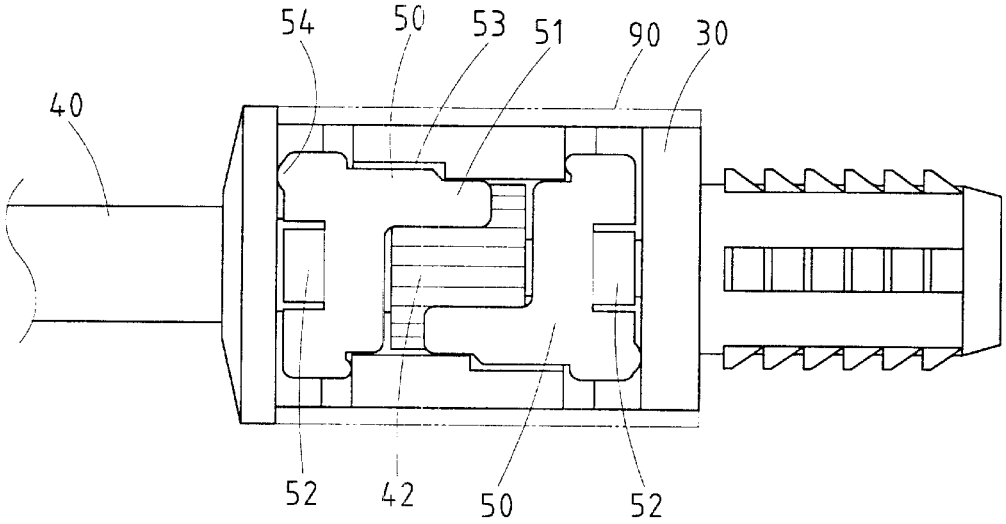
FIG. 9 shows a longitudinal top sectional view of the preferred embodiment of the present invention.

As shown in FIG. 9, the check plates 50 are engaged with the gear 42 of the shank 40. The protruded pieces 51 of the check plates 50 are reinforced by the reinforcing edges 53. In addition, the displacement of the check plates 50 is minimized by the protruded edges 54 of the check plates 50, which press against the side walls of the disposition slot 34 of the main body 30. In other words, a reaction force is brought about by the protruded edges 54 so as to prevent the check plates 50 from displacing.

Figure 10:
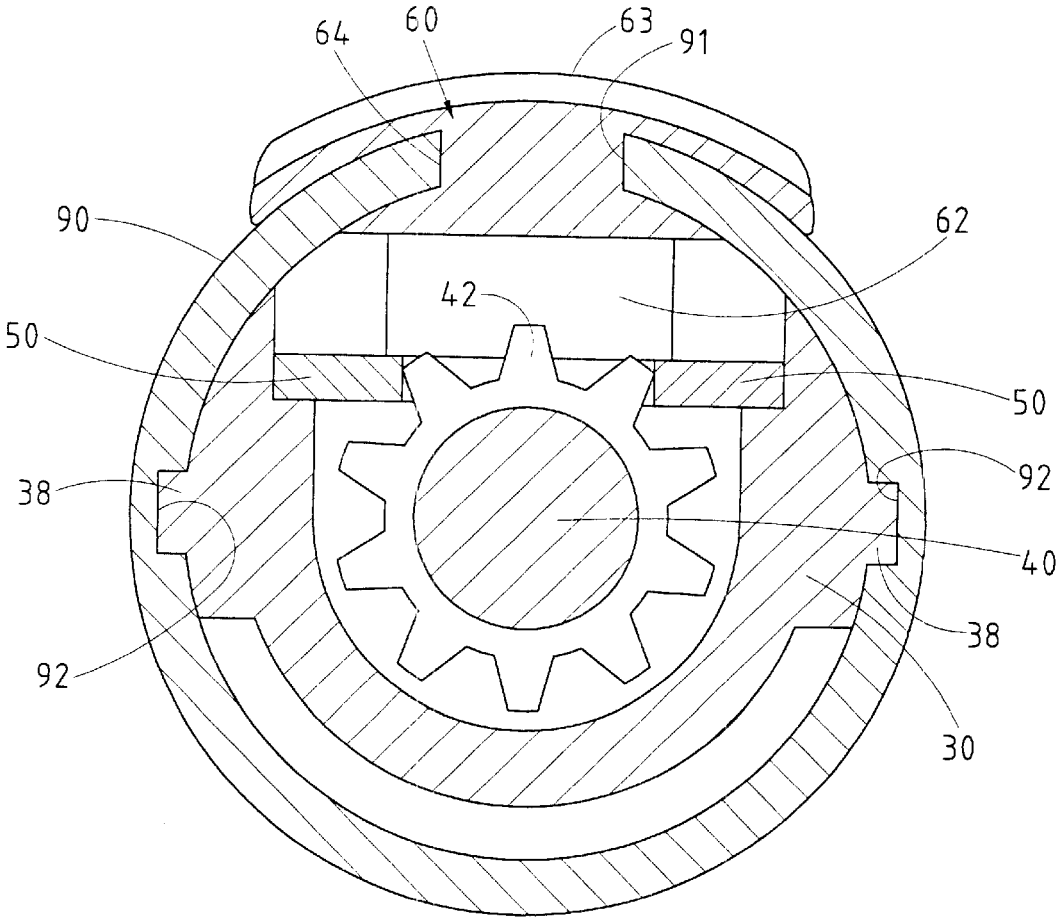
FIG. 10 shows a cross-sectional view of the present invention.

As shown in FIG. 10, the tubular housing 90 is prevented from turning by means of two locating slots 92 in which the ribs 38 of the main body 30 are received.

The embodiment of the present invention described above is to be regarded in all respects as being merely illustrative and nonrestrictive. Accordingly, the present invention may be embodied in other specific forms without deviating from the spirit thereof. The present invention is therefore to be limited only by the scope of the following claim.

I claim:

1. A ratchet screwdriver comprising:

a handle;

a main body fastened at one end to said handle and provided at another end with an axial hole having a core hole and an open top, said main body further comprised of two disposition slots located at two sides of said axial hole, said main body further comprised of, in a bottom side thereof, an insertion slot in communication with said axial hole;

a shank provided at an outer end with a tip slot, and at an inner end with a gear having a pillar, said shank being pivoted in said axial hole of said main body such that said pillar of said gear is received in said core hole of said axial hole;

a tubular housing comprising an assembly slot and fitted over said main body;

a shifter mounted on said assembly slot of said tubular housing and comprised of two feet;

two check plates comprising a protruded piece and disposed in said disposition slots of said main body such that said check plates are actuated by said shifter to cause said protruded piece to engage said gear of said shank; and a position confining plate comprising a plate body and disposed in said insertion slot of said main body such that said plate body obstructs said gear of said shank so as to prevent said shank from sliding out of said main body;

wherein said check plates are comprised of an inclined edge, a reinforcing edge, and a protruded edge, said inclined edge enabling said check plates to be effectively actuated by said feet of said shifter, said reinforcing edge serving to enhance the structural strength of said check plates, said protruded edge pressing against side walls of said disposition of said main body to bring about a reaction force to prevent said check plates from displacing at the time when said check plates are actuated by said shifter to engage said gear of said shank;

wherein said main body is provided in an outer wall with two protruded ribs extending along the longitudinal direction of said main body; wherein said tubular housing is provided in an inner wall with two locating slots corresponding in location to said two protruded ribs of said main body whereby said tubular housing is fitted over said main body such that said two protruded ribs of said main body are located in said two locating slots of said tubular housing, thereby preventing said tubular housing from turning;

wherein said main body is comprised of two guide slots; wherein plate body of said position confining plate is comprised of two pillars whereby one end of said pillars is received in one of said two guide slots of said main body, with another end of said pillar being provided with a spring fitted thereover such that said position confining plate is urged by said spring to press against one side wall of said insertion slot of said main body.

* * * * *